United States Patent [19]

Andriulis

[11] 4,123,201

[45] Oct. 31, 1978

[54] MODULAR VACUUM PUMP ASSEMBLY

[75] Inventor: Vytautas Andriulis, Chicago, Ill.

[73] Assignee: Central Scientific Company, Inc., Chicago, Ill.

[21] Appl. No.: 394,092

[22] Filed: Sep. 4, 1973

[51] Int. Cl.[2] ..... F04B 23/10; F04B 17/00; F04B 35/04; F16D 3/14

[52] U.S. Cl. ..... 417/204; 417/360; 417/410; 64/27 NM

[58] Field of Search ..... 415/121; 417/410, 219, 417/204, 359, 423 R, 360; 418/97, 69; 64/27 NM

[56] References Cited

U.S. PATENT DOCUMENTS

| | | | |
|---|---|---|---|
| 939,829 | 11/1909 | Grundy | 64/11 R |
| 1,509,917 | 9/1924 | Westinghouse | 418/97 |
| 2,017,302 | 10/1935 | Yoder | 417/359 |
| 2,280,979 | 4/1942 | Rocke | 417/424 |
| 2,294,352 | 8/1942 | White | 417/204 |
| 2,382,539 | 8/1945 | Brady, Jr. | 417/410 |
| 2,764,100 | 9/1956 | Maisch | 417/360 |
| 2,880,678 | 4/1959 | Hoffer | 418/133 X |
| 3,088,416 | 5/1963 | Danis | 417/423 |
| 3,225,930 | 12/1965 | Willinger | 417/424 |
| 3,282,222 | 11/1966 | Raufeisen et al. | 417/410 |
| 3,383,883 | 5/1968 | Dutaret | 64/27 NM |
| 3,399,826 | 9/1968 | Andriulis | 417/204 |
| 3,491,699 | 1/1970 | Yowell | 418/133 |
| 3,525,578 | 8/1970 | Le Blanc, Jr. | 418/97 |
| 3,565,550 | 2/1971 | Bellmer | 417/204 |
| 3,743,453 | 7/1973 | Abendschein et al. | 418/97 |
| 3,881,849 | 5/1975 | Commarmot et al. | 418/182 |

*Primary Examiner*—Carlton R. Croyle
*Assistant Examiner*—Thomas I. Ross
*Attorney, Agent, or Firm*—Haight, Hofeldt, Davis & Jambor

[57] ABSTRACT

A vacuum pump assembly has a conventional electric motor, a mounting plate centered with respect to the drive shaft of the motor, and a self-contained, replaceable modular pumping apparatus. The module has a stator, a rotor, and axially opposite end plates enclosing a pumping chamber, and is detached easily, quickly mounted onto the mounting plate as a unitary assembly, and operatively connected to the drive shaft of the motor by a shock-absorbing self-aligning coupling. It is enclosed by a pump housing containing lubricant for lubrication and sealing purposes during pump operation. The pumping module has a double seal to maintain lubricant and to allow the shaft connected to the rotor to center itself relative to the mounting plate and the motor. The module is in communication with intake and gas ballast ports through passageways in the mounting plate to provide for gas transfer therethrough, and optionally contains passageways formed in the interior face of one of the end plates which connect with vanes reciprocating in radial slots formed in the rotor to allow secondary pumping of fluids within the pumping chamber.

2 Claims, 9 Drawing Figures

MODULAR VACUUM PUMP ASSEMBLY

BACKGROUND OF INVENTION

This invention relates to rotary displacement, or piston, pumps, and more particularly concerns fluid sealed rotary pumps adapted for producing high vacuums or moderate pressures. Although not so limited, the invention is particularly directed to guided vane type rotary displacement pumps having an eccentrically mounted stator; which pumps are especially useful for rapidly producing high vacuum or generating moderate pressures on the order of one atmosphere gauge.

Fluid sealed, rotary displacement, vacuum pumps, are widely used in laboratories and in industry for producing relatively high vacuum or generating moderate pressures. Customarily, they employ a rotary piston, or rotor, having a number of radially movable flat vanes, which rotor rotates within an eccentrically mounted stator. Centrifugal force tends to extend the vanes outwardly as the rotor rotates; the resulting volume change produced by stator extracts gases from a vacuum inlet and thereafter discharges the resulting compressed gases through a pressure outlet conduit. A nonreactive fluid, typically mineral oil, serves both to seal the pump components, to lubricate areas in frictional contact, and to reduce pump dead space.

Although widely used, rotary displacement vacuum pumps frequently suffer a number of disadvantages. Primarily, the pump designer is required to balance manufacturing simplicity, operational durability, and economy against high vacuum efficiency, not always with satisfactory results. Furthermore, even the best of rotary displacement pumps undergoes wear, usually at the vanes, and must be repaired or replaced with annoying frequency.

Accordingly, an object of the invention is to provide a durable, rugged, low cost, rotary displacement vacuum pump having an unusually high pumping speed. Still another object is to provide such pump having relatively few wearing parts, and including a means for rapidly removing and replacing as a unit all parts which are subject to wear. Yet another object is to provide a fluid sealed, rotary displacement, vacuum pump assembly in which the pumping components are contained within a single pump module, which may be renewed without careful alignment of parts, without undue down time, and without requiring a separate inventory of replacement parts.

Other and further objects, aims, and advantages of the invention will become apparent as the description thereof proceeds.

SUMMARY OF THE INVENTION

Briefly, in accordance with the invention, there is provided a fluid sealed, rotary displacement, vacuum pump assembly of the type having a rotatable rotor with a plurality of radially extending vanes, and an eccentrically mounted stator surrounding the rotor. A rotor drive motor is mounted onto a mounting plate, the motor having a drive shaft extending to or through the plate. All of the stator components, and all of the rotor components, form a unitary, modular assembly which is likewise mounted onto the mounting plate, while a detachable coupling is employed to removably secure the drive shaft to the rotor. A particular feature of the invention is that the entire stator and rotor module is removeable and replaceable as a single unit.

When intended for generating pressure, the rotor-stator assembly is contained within a pressure and fluid tight housing, and a discharge conduit leading from the housing thereby produces a pressure on the order of an atmosphere or so gauge.

In a preferred embodiment, the pumping module includes a cylindrical stator assembly having a circular bore, together with a pair of flat end plates. A surface of either or both of these plates may be provided with secondary pumping conduits, to be explained presently, for improving the high vacuum pumping efficiency. Additionally, the pump may be equipped with a gas ballast system, both of which are more fully described in Andriulis U.S. Pat. No. 3,399,826, the disclosure of which is hereby incorporated by reference herein.

BRIEF DESCRIPTION OF DRAWINGS

Other objects and advantages of the invention will become apparent from the following detailed description and upon reference to the drawings, in which:

FIG. 3*a* is an axially exploded view of the modular pumping assembly of FIG. 3.

DETAILED DESCRIPTION

Figures 1, 2, 3:
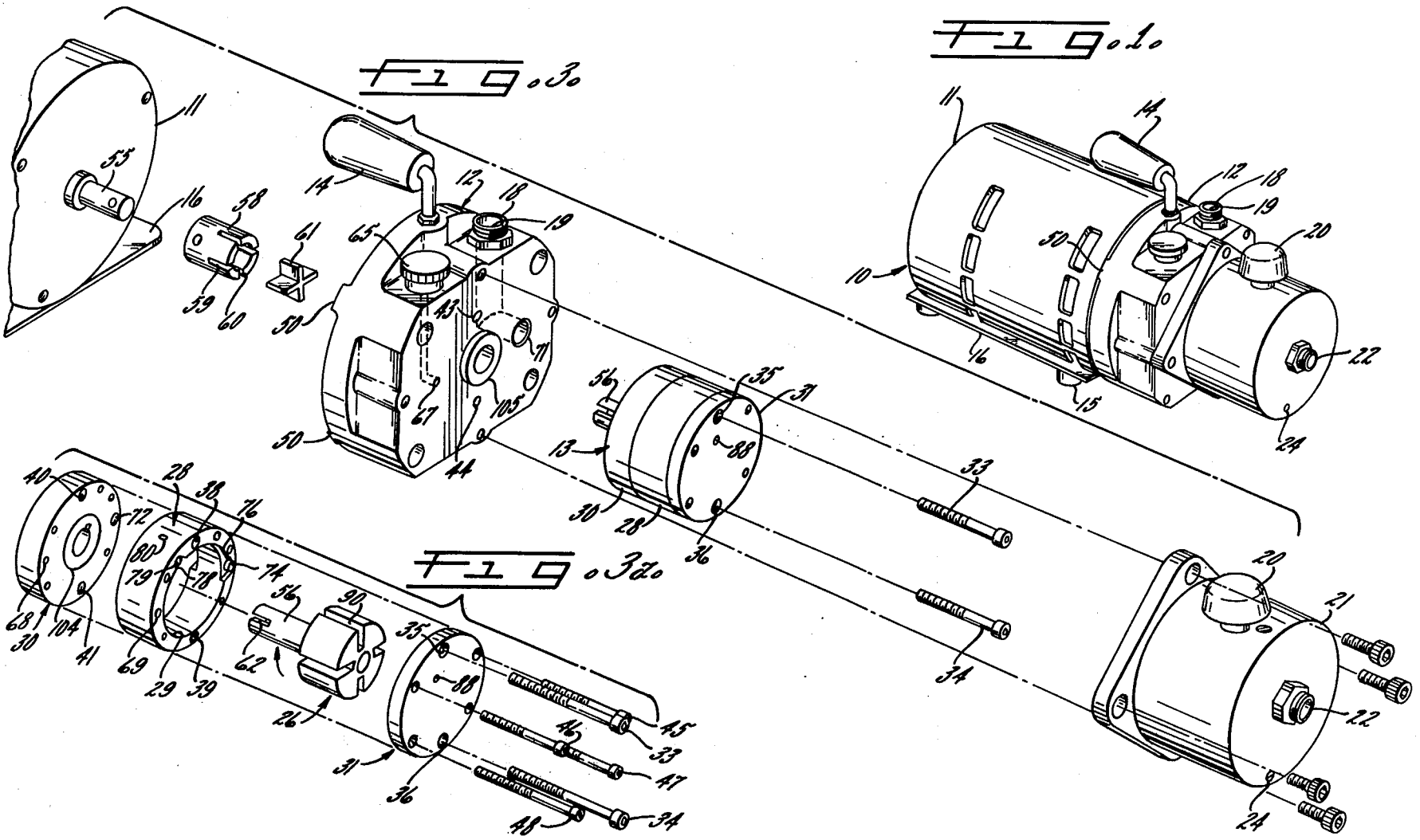
FIG. 1 is a perspective view of a direct drive vacuum pump assembly according to the present invention.
FIG. 2 is a slightly enlarged side elevational view of the direct drive vacuum pumping assembly shown in FIG. 1 showing the mounting plate and housing and modular vacuum pump in cross section.
FIG. 3 is an axially exploded view showing the mounting assembly connection and modular vacuum pumping assembly of the present invention which is shown in cross section in FIG. 2.
Figure 2:
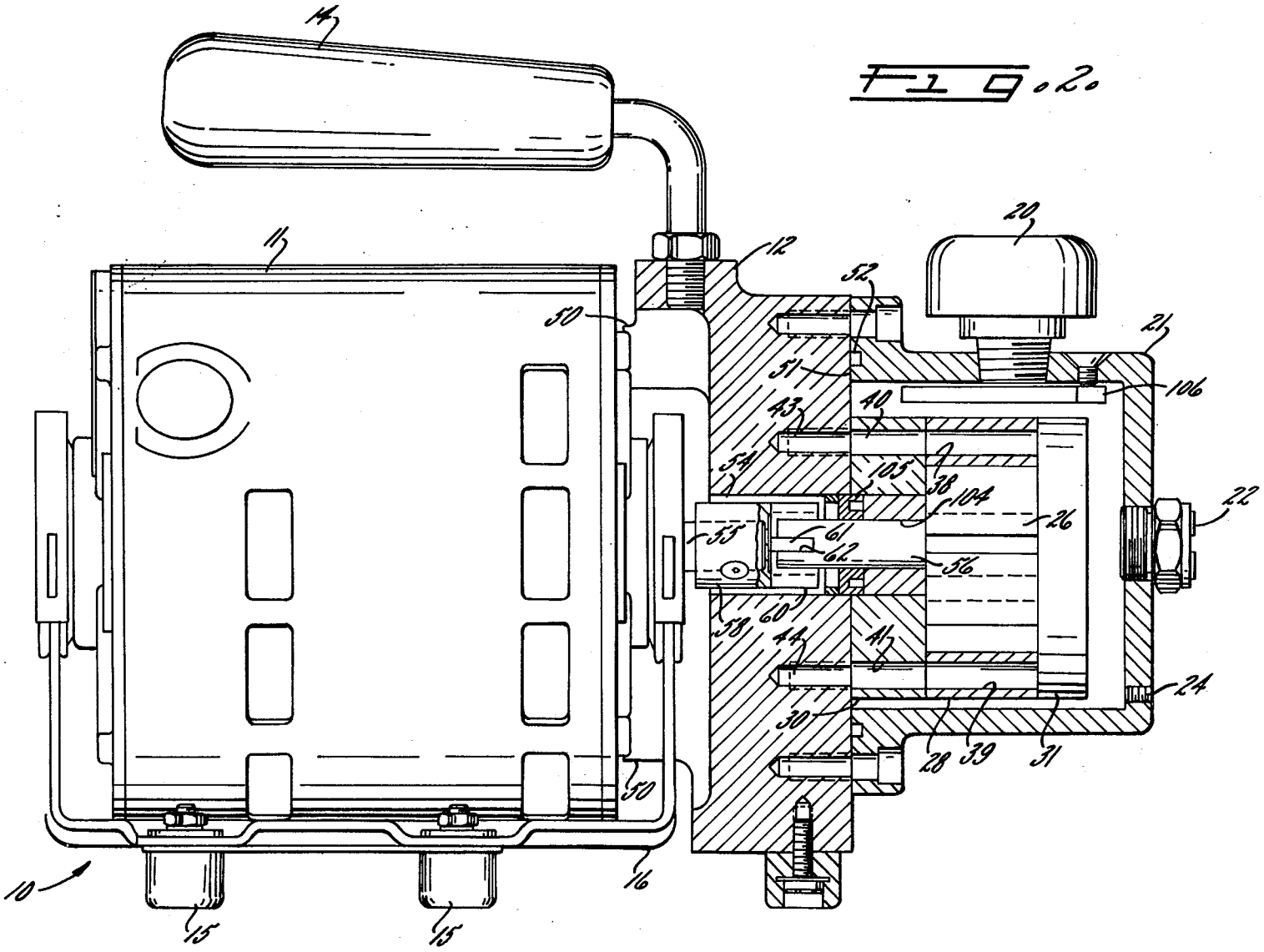

The complete vacuum pump 10 is shown in perspective in FIG. 1 and, in exploded view, in FIGS. 3 and 3*a*. An assembled sectional view of the pump, illustrating the relation of the exploded elements of FIGS. 3 and 3*a* is contained in FIG. 2.

Referring to these figures, and particularly FIG. 1, the pump 10 includes a conventional electric motor 11 mounted onto a mounting plate 12, which may be equipped with a carrying handle 14 where the size and weight of the pump assembly 11 is conducive to portability. Similarly, a set of rubber feet or bumpers 15 affixed to a lightweight frame 16 allows the assembly 11 to be positioned temporarily in any required location.

Continuing to refer mainly to FIG. 1, the vacuum pump 10 includes an inlet fitting 18 communicating with a vacuum inlet conduit 19, and a pump discharge vent 20 which discharges pressure to the atmosphere. The vent 20 is mounted near the top of a generally cylindrical fluid and pressure tight housing 21 equipped with an oil level sight glass 22 at approximately its center-line, and an oil drain tap 24 near a lower portion of the housing 21.

FIG. 3 and, in more detail, FIG. 3*a* are useful in obtaining an overall orientation of the main pump components. In substance, a pumping module 13 is provided which includes a rotor 26, a stator 28 which includes a circular bore 29 that is eccentric with respect to the rotor 26, and a pair of flat plates, namely an intermediate plate 30 and an end plate 31. The plates 30, 31, when assembled at the ends of the stator 28, provide the eccentric housing for the rotor 26. A unitary module is thus defined by the rotor and stator components that is attachable and detachable to the mounting plate 12 by only two threaded bolts 33, 34. These bolts 33, 34 extend through a pair of holes 35, 36 in the end plate 31, a similar pair of holes 38, 39 in the stator cylinder 28, another similar pair of holes 40, 41 in the intermediate plate 30, and a pair of tapped holes 43, 44 in the mounting plate 12. A shorter set of bolts 45, 46, 47, 48 are threaded through corresponding holes in the end plate 31 and the stator body 28 and into corresponding tapped holes in the intermediate plate 30 so that the two plates and the stator body remain as a unitary assembly upon removal of the pumping module from the mounting plate 12.

As best shown in FIGS. 1, 2, and 3, the mounting plate 12 is a generally flat plate having positioning flange 50 spaced around its periphery on the side adjacent the motor 11 to insure accurate registration between the mounting plate 12 and the motor. On the face 51 opposite the motor 11, the surface is machined relatively flat to insure firm mounting of the pump module 13. The flat surface 51 also serves as a mounting face for the correspondingly flat surface of the flight tight housing 21, the latter of which is desirably provided with a groove 52 at its mating surface to accommodate an O-ring seal.

Figure 4:
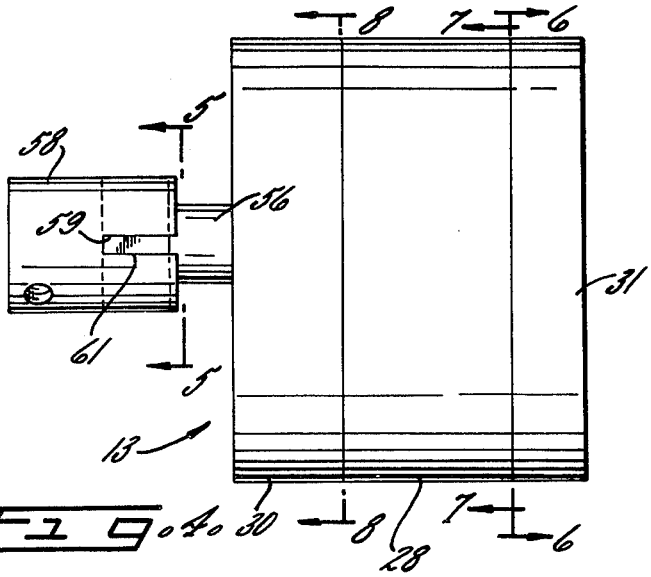
FIG. 4 is a side elevational view of the modular vacuum pumping assembly and connector of the present invention showing FIG. 2.
Figure 5:
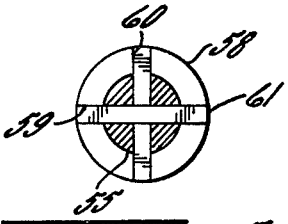
FIG. 5 is a vertical cross-sectional view taken along line 5—5 of FIG. 4 showing one end of the connector.

To transmit power from the motor 11 to the rotor 26, a special coupling assembly is desirably provided. As best shown in FIGS. 2 and 3, 3*a*, to be taken in conjunction with FIGS. 3, 4 and 5, the coupling assembly extends between the motor 11 and the rotor 26 via an oversized circular aperture 54 bored through the mounting plate 12. The coupling, which is designed to insure vibration and noise-free power transmittal and to obviate the need for accurate axial and radial alignment of the motor drive shaft 55 and the corresponding rotor shaft 56, employs the combination of an oversized tubular coupling collar 58 provided with a pair of cruciform slots 59, 60 into which is received a polyurethane or other elastomeric crosspiece 61 (FIG. 3). The crosspiece 61 also engages a pair of cruciform slits 62 machined at the motor end of the rotor shaft 56. Thus, while there is no direct contact between the motor shaft 54 and the rotor shaft 56, with no attendant vibration or noise, the two rotate together by virtue of the interlocking action of the slits against the crosspiece 61 arms. As further indicated in FIG. 1, the coupling flexible collar 58 is screwed or pinned onto the motor drive shaft 55.

Gas ballast, as more fully described in the Andriulis patent U.S. Pat. No. 3,399,826, is conveniently provided by utilizing a simple air bleed to supply atmospheric air into the area between the rotor 26 and the stator 38. Gas ballasting, which is essentially an air bleed or leak into the pumping chamber, is designed to sweep out condensible vapors from the pump which would otherwise be compressed and thereby condensed during vacuum pumping. This function is provided by equipping the mounting plate 12 (FIG. 3) with a knurled nut 65 affixed to a threaded rod which extends into a similarly threaded tapped conduit 67 and which communicates via a conduit 68 in the intermediate plate 30, and a conduit 69 in the stator 28, into the cavity of the stator body 28.

Figure 6:
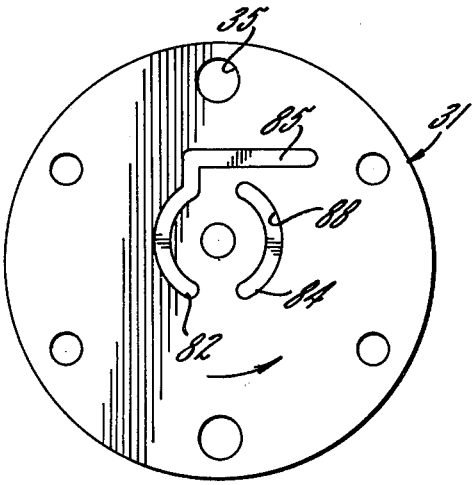
FIG. 6 is a vertical cross-sectional view taken generally along line 6—6 of FIG. 4 showing one of the end plates of the modular pumping assembly.
Figure 7:
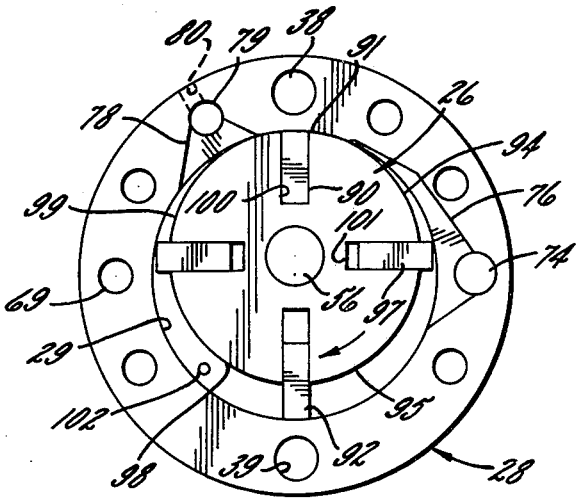
FIG. 7 is a vertical cross-sectional view taken generally along line 7—7 of FIG. 4.
Figure 8:
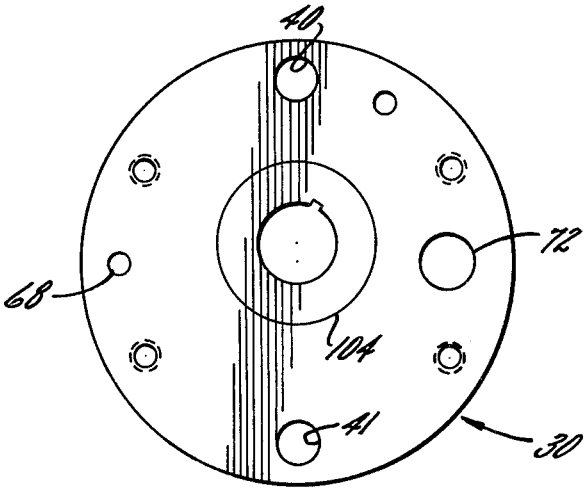
FIG. 8 is a vertical cross-sectional view taken generally along line 8—8 of FIG. 4.

The mounting plate 12 also accommodates the vacuum inlet fitting 18 (FIG. 3) which leads to a vacuum inlet conduit 19 extending through the plate 12 and terminating in an O-ring equipped aperture 71 in the face of the mounting plate 12. This in turn communicates with a vacuum intake conduit 72 in the intermediate plate 30 and a communicating conduit 74 in the stator body 28. As best shown in FIG. 7, portions of both of the ends of the stator body 28 adjacent the inlet conduit 74 are milled away to form an intake plenum 76, which extends approximately one fourth of the periphery of the cylindrical bore 29 of the stator 28. A similar, though smaller, pair of compression plena 78 extend to a discharge conduit 79 drilled through the stator body 28, which vents via a light-weight ball check valve 80 into the interior of the fluid tight housing 21. Some additional descriptive information is desirable before proceeding to a discussion of the operation of the pump assembly. Turning first to FIG. 6 showing an internal view of the end plate 31, the innerfacing surface has a pair of milled arcuate conduits 82, 84, which provide the secondary pumping action to be explained presently. The first conduit 82 connects with a milled conduit 85 that communicates with the intake plenum 76 (FIG. 7), while the exhaust conduit 84 discharges via a spring-loaded check valve 88 to the interior of the fluid tight housing 21 (FIG. 3).

Operation of the pump is best considered with reference to FIG. 7, also maintaining attention to FIGS. 3 and 3*a*. Basically, as the rotor 26 rotates rapidly in the indicated direction, each of the four vanes 90 is thrown radially outward by centrifugal force, to remote positions limited by the inner surface of the cylindrical bore 29 of the stator body 28. Since the bore 29 is eccentric with respect to the center-line of the rotor 26, the space between the bore 29 and the rotor is a crescent in the end view of FIG. 7; ideally, the rotor 26 almost contacts the bore 28 at the perigee 91, and is at its maximum distance from the bore at the apogee 92.

As may be envisioned from an inspection of FIG. 7, clockwise rotation of the rotor 26 places the upper right hand quadrant 94 of the crescent in communication with the inlet plenum 76 of the stator. As the rotor 26 continues to rotate, the vanes 90, 97 isolate the intake plenum 76, and as rotation continues to the second quadrant 95, this expands the initially smaller quadrant 94, thereby effecting a vacuum production. When the rotor rotates another quarter turn, to the quadrant 98, compression begins, and continues again through the fourth quadrant 99 where gases are now under compression and are then discharged via the compression plenum 78 and ultimately through the check or relief valve 80 and thence through the vent 20 (FIG. 1).

Earlier it was noted that a secondary or supplemental pumping system is desirably employed, as was described in conjunction with FIG. 6. This secondary pumping system functions only when the vacuum at the intake plenum 76 (FIG. 7) becomes so low in relation to the pressure at the compression or discharge plenum 78 that the small amount of leakage across the perigee 91 essentially equals the pumping capacity of the pump under those conditions. When this occurs, a more efficient pumping system is required.

This latter pumping system is provided by the pumping action of the several vanes 90 in their respective slots 100. As indicated in FIG. 7, each vane 90, 97 etc. moves a rather large distance—equal to the difference in diameters between the rotor 26 and the stator bore 29—during a pumping cycle. This distance, or rather this space, is utilized in conjunction with the conduits shown in FIG. 6 to withdraw a small amount of the gases at the intake plenum 76 around the vane 97, trap and compress it in the portion of the cycle between the conduits 82 and 84, and then discharge it via the conduit 84 to the exhaust check valve 88 as the pumping cycle continues.

In lieu of the exhaust conduit 84 (FIG. 6) and check valve 88 on the end plate 31, a more simplified and yet more efficient supplementary compression system may be employed. By drilling a hole from the bottom of each of the radial slots 100 (FIG. 7) in the rotor 26 to the central port or aperture in the rotor, and by placing a resilient elastomeric tube in the aperture to seal each of the holes until a pressure difference is developed sufficient to overcome the resiliency of the tube, the need for check valves in the supplementary system may be dispensed with. Thus, as the pressure builds up in the lower portion each radial slot 100, 101, etc. as it rotates in the direction shown in FIG. 7, the resulting pressure is released into the central aperture of the rotor 26 via the resilient tube, where it then discharges through the end plate 31 (FIG. 3) via a central aperture, not shown.

Earlier it was noted that pumps of this type are conventionally sealed and lubricated with a moderate viscosity liquid such as 20-weight mineral oil. This oil normally occupies about half of the height of the fluid tight housing 21 (FIGS. 1, 2, 3), and is introduced into the interior of the pumping module (FIGS. 3*a* and 4), preferably via a small oil hole 102 (FIG. 7) communicating into the interior of the pump. The oil circulates with the air or other gas being pumped, exits via the check valves 80 (FIG. 7) or 88 (FIG. 6), and returns to the interior of the housing 21. Oil leakage from the interior of the pump and air leakage into the pump is prevented by one or more circumferential oil seals 105 for the bearing 104 (FIG. 2) mounted in either the module 13 or the mounting plate 12, while splashing through the vent 20 (FIGS. 1 and 2) is avoided by a semi-cylindrical oil deflector or baffle 106.

Thus it is apparent that there has been provided, in accordance with the invention, a lightweight, compact, high efficiency rotary displacement type vacuum pump. Should any of the active pumping components, or the bearing 104 or the oil seal 105, fail or wear, the entire pumping module (FIGS. 3a and 4) may readily be removed from the pump, and replaced as a single unit without inordinate down time. Moreover, the replacement requires no careful alignment, a feature provided by the module-mounted bearing 104 and a drive shaft coupling system comprising the collar 58, the crosspiece 61, and the slit rotor shaft 56.

While the invention has been described in conjunction with specific embodiments thereof, it is evident that many alternatives, modifications, and variations will become apparent to those skilled in the art in light of the foregoing description. Accordingly, it is intended to embrace all such alternatives, modifications, and variations as fall within the spirit and broad scope of the appended claims.

I claim as my invention:

1. A rotary displacement vacuum pump assembly incorporating a rotor drive motor and comprising:

a mounting plate, the rotor drive motor being mounted on one side of said mounting plate;

a pump housing mounted on the opposite side of said mounting plate;

a stator body portion with an internal cavity that provides a pumping chamber;

a rotor located in said pump chamber;

a pair of end plates positioned on either end of said stator body portion;

fastening means to rigidly connect said end plates to said stator body portion to form an integral modular pump assembly, said modular pump assembly having a vacuum inlet and a pressure outlet;

mounting means to releasably connect said modular pump assembly to said mounting plate within said pump housing;

a coupling collar rigidly connected to the drive shaft of the rotor drive motor, a pair of cruciform slots being formed in said collar;

a pair of cruciform slits formed in the motor end of the rotor shaft; and an elastomeric crosspiece to fit into said slots of said coupling collar and said slits in the rotor shaft to provide a driving connection between the rotor drive motor and said rotor.

2. A rotary displacement vacuum pump assembly incorporating a rotor drive motor with a motor drive shaft and comprising:

a mounting plate, the rotor drive motor being mounted on one side of said mounting plate;

a stator body portion with an internal cavity to provide a pumping chamber;

a rotor having a plurality of rotor vanes located in said pumping chamber;

a rotor shaft affixed to said rotor to mount said rotor in said pumping chamber;

an intermediate plate to close the end of said pumping chamber adjacent said mounting plate, said intermediate plate including a bearing for said rotor shaft;

an end plate to close the other end of said pumping chamber;

fastening means to rigidly interconnect said intermediate plate, said stator body portion and said end plate to form an integral modular pump assembly;

mounting means to releasably connect said modular pump assembly to said mounting plate;

a detachable flexible coupling to connect the motor drive shaft to said rotor shaft through said mounting plate;

a vacuum inlet conduit in said mounting plate;

a vacuum intake conduit in said intermediate plate and said stator body portion communicating with said vacuum inlet conduit and extending into said pumping chamber;

a gas-ballast conduit extending from atmosphere to said pumping chamber through said mounting plate, said intermediate plate and said stator body portion;

a fluid-tight pump housing mounted on said mounting plate and surrounding said modular pump assembly;

a discharge conduit in said stator body portion extending from said pumping chamber to the space between said pump housing and said modular pump assembly;

a first check valve located in said discharge conduit to close said discharge conduit except when releasing pressure from said pumping chamber;

a secondary pumping arrangement to increase pumping efficiency, the pressure created by said secondary pumping arrangement being released into said space between said pump housing and said modular pump assembly;

a discharge vent in said pump housing to release pressure to atmosphere, a coupling collar rigidly connected to the drive shaft of the rotor drive motor, a pair of cruciform slots being formed in said collar;

a pair of cruciform slits formed in the motor end of the rotor shaft; and an elastomeric crosspiece to fit into said slots of said coupling collar and said slits in the rotor shaft to provide a driving connection between the rotor drive motor and said rotor.

* * * * *